United States Patent [19]

Emmerich

[11] 4,048,117

[45] Sept. 13, 1977

[54] VACUUM SWITCH CONTACT MATERIALS

[75] Inventor: Werner S. Emmerich, Pittsburgh, Pa.

[73] Assignee: Westinghouse Electric Corporation, Pittsburgh, Pa.

[21] Appl. No.: 518,908

[22] Filed: Oct. 29, 1974

[51] Int. Cl.[2] ..... H01B 1/02; H01B 1/06

[52] U.S. Cl. ..... 252/513; 252/512; 252/514; 252/516; 252/519; 252/520; 428/539.5; 200/265

[58] Field of Search ..... 252/514, 516, 518, 519, 252/520; 29/182; 200/DIG. 42, 265

[56] References Cited

U.S. PATENT DOCUMENTS

| | | | |
|---|---|---|---|
| 2,246,328 | 6/1941 | Smith | 75/153 |
| 3,819,897 | 6/1974 | Peche et al. | 200/263 |
| 3,913,201 | 11/1975 | Schreiner et al. | 252/519 |

FOREIGN PATENT DOCUMENTS

| | | | |
|---|---|---|---|
| 1,194,674 | 5/1966 | United Kingdom | 200/144 |

*Primary Examiner*—Benjamin R. Padgett
*Assistant Examiner*—Josephine Lloyd
*Attorney, Agent, or Firm*—R. T. Randig

[57] ABSTRACT

A material is described which is useful in electrical current switching devices and is especially adapted to form the contact surface of the electrodes of electrical current switching devices which are employed in a vacuum environment. The contact material comprises a major component which is characterized by a melting point in excess of 1250° C and a boiling point of less than 3500° C. A small but effective amount of an element which provides antiwelding characteristics and in which said element has only minimum solubility within the major component. The balance is a minor constituent for providing a low resistance path for the electrical current to flow from one electrode to the other. Typical compositions includes a chromium matrix material which comprises in excess of 50% by weight of the contact material, up to about 1.5% of an antiwelding element for example bismuth and the balance essentially a high electrical and thermal conductivity element notably copper or silver. These ingredients are compounded and are formed into the shape of a contact material which is attached to the electrodes in electrical current switching devices.

8 Claims, No Drawings

VACUUM SWITCH CONTACT MATERIALS

CROSS REFERENCE TO RELATED APPLICATIONS

The present invention is closely related to application Ser. No. 589,979 filed June 24, 1975 and application Ser. No. 521,808 filed Nov. 7, 1974.

BACKGROUND OF THE INVENTION

1. Field of the Invention

The present invention relates to electrical current switching devices which employ or which are actuated in a vacuum environment and more particularly the invention relates to contact materials which are utilized on the surface of the electrodes which are employed in switching electrical current.

2. Description of the Prior Art

In electrical current switching devices, the electrical circuit is opened and closed by making or breaking contact between two electrode structures which are operating within a vacuum environment. Consequently, the contact surface of the electrode structures becomes of critical importance.

In such electrical current switching devices, heat is generated due to the passage of electrical current at locations where resistance is encountered. This occurs at places where the electrodes touch and more severely during opening and closing operations provided that the electrical potential is sufficiently high to cause the flow of current in the form of an electrical arc. One consequence of the heat which is evolved during such operations is the formation of hot spots on the surface of the electrodes. These hot spots can lead to the softening or melting of some of the material and if the electrodes are in contact or brought into contact with one another at such time, especially where there is molten or near molten material on the surface of said electrodes, undesirable welding of the electrodes can occur. It has been found that when such electrodes are employed in a vacuum environment, the problem of welding of the electrode contact surfaces together becomes more accentuated.

A proposed solution to this problem is to recognize that such welding does take place. The characteristics of the weldment and particularly the strength thereof must be adjusted so that the welding which may take place will be of sufficiently low strength that the weld may be readily broken without unduly distorting or changing the surface of the contact material at which said weld occurs. In addition, the fundamental characteristics of the contact materials, namely, good current interruption ability, high voltage withstand capability and low electrical resistance including low chopping and low erosion characteristics must not be altered during operation. In the past various compromises have been proposed with the materials which form the contact surface of the electrodes.

One approach has been to utilize a major proportion of a very strong element and form a sintered network of powdered particles of this material and thereafter infiltrate the same with a lesser amount of another component which will produce a compromise in the various characteristics of the individual components. Typical of such materials has been the employment of a major constituent comprising a refractory metal such as tungsten or molybdenum which is characterized by an exceedingly high melting point and thereby minimize the welding tendency of the electrode. A pure sintered refractory metal contact formed for example, of tungsten, will not provide the required electrical conductivity nor the chopping characteristics and high voltage withstand capability. These characteristics are supplied by infiltrating the sintered matrix with a material of good electrical conductivity and low chopping characteristics but which may suffer from high erosion and lower voltage withstand capability. Notably, such an element is copper or silver. This latter component has always been present in a minor proportion.

Other approaches to the solution of the same problem has involved other compromises and the materials have comprised typically a copper matrix in which copper is the major constituent to which is added another component of limited solid solubility such that between the two components there is a brittle material which will aid in breaking any welds which do occur during arcing when the electrical current switching device is in operation. Typical of these materials are the copper-bismuth and silver-tellurium type contacts. Representative of such prior used contact materials are those described, for example, in the Lafferty et al. U.S. Pat. No. 3,246,979, U.S. Pat. No. 2,246,328 to Smith which discloses the introduction of traces of bismuth in copper for improving the current voltage characteristics of asymmetrical conductors and U.S. Pat. No. 1,375,454 to Hanson which describes an electrical resistance alloy having a chromium content ranging from 30 to 60% together with 30 to 60% of copper and up to 5% of tungsten and molybdenum. Clearly such latter materials while being effective for an electrical resistance alloy are totally unsuited for contact materials for use in a vacuum interrupter.

SUMMARY OF THE INVENTION

The present invention relates to contact materials which find use in vacuum interrupters. The contact material comprises a matrix material which is present in an amount in excess of 50% by weight of the contact material. The matrix material is characterized by having a melting point in excess of about 1250° C and a boiling point of less than about 3500° C. The contact material also includes about 0.3% to about 2% of an antiwelding element which antiwelding characteristics are displayed in a vacuum environment. Moreover, the antiwelding element must have a solubility of less than about 1.5% at the melting point temperature of the matrix material. The balance of the contact material essentially comprises a metal having a high electrical and thermal conductivity. A typical composition would include a matrix comprising chromium in an amount in excess of 50%, a minor constitutent of high electrical thermal conductivity namely copper or silver and from about 0.3 to about 2.0% of bismuth.

DESCRIPTION OF THE PREFERRED EMBODIMENT

The contact materials are preferably composed of a major constituent and at least one minor constituent. The major constituent consists of the material which exhibits a high melting point and a relatively high vapor pressure at its melting point compared to refractory metals. The purpose of the major constituent is to provide physical strength for the electrode structure and to maintain erosion at a very low level. It is imperative that this erosion rate be maintained at a low level even at the relatively high temperatures encountered in the neighborhood of an electrical arc. Consequently, in order to fulfill this characteristic the melting point of the major constituent is selected to be at a temperature above about 1250° C. While numerous materials will fulfill this criteria, care must be exercised in order to avoid undesirable thermionic emission and consequently, the boiling point of the selected major contituent, either the material itself or that of its dissociation products, must be less than about 3500° C.

In addition, the candidate materials are preferably those with high sublimation rates since sublimation tends to minimize splashing which would result in the subsequent degradation of the high voltage withstand capability of the interrupter due to surface irregularities caused by such splashes. Consequently, the major constituent must not be a refractory metal in the sense that it has a melting point in excess of about 1900° C. Included within the desirable class of constituents are those metals chromium, iron, zirconium, cobalt, nickel, manganese and alloys thereof. The foregoing list also includes ceramic-type constituents such as borides and carbides of each of the foregoing elements.

One method of producing the electrode structure and more particularly the contact surface from the foregoing major constituents is to form a sintered matrix from the major constituent and then infuse the additives dissolved in the minor constituent in its liquid form. Alternatively, powder metallurgical techniques can be employed in which the various components are mixed in powdered form and then treated under heat and pressure until a mechanically strong electrode contact material is achieved. In order to provide for sufficiently low gas contents and to aid in the suitability of the major constituent, sufficient titanium or zirconium may be added to provide a residue of up to 0.25% in the contact material.

The minor constituent of the contact material consists of an alloy or a mixture of metals having the capability of providing a low resistance path for the electrical current to flow from one electrode to the other, supply improved thermal conductivity for conveying heat away from the force of the contact material and the minimizing of the welding techniques of the contact surfaces. A number of metallic mixtures are suggested to accomplish these functions. Thus in order to provide the requisite characteristics, the minor constituent generally comprises two components, one to furnish the electrical conductivity and the other to prevent the formation of strong welds. In this particular respect the welds are prevented by the addition of such elements as bismuth, lead, tellurium, thallium and similar low strength metals which form a brittle intermetallic compound thereby decreasing the ductility of the welds and thereby enabling the weld to be broken more readily. The balance of the contact material essentially comprises those materials of high electrical and thermal conductivity. These metals usually consist of silver, copper and aluminum.

The antiweld element of the minor constituent should be present in an amount of between 0.3% to about 2.0% for providing the antiweld characteristics within the vacuum environment. Consequently, one of the essential characteristics of the antiwelding element must be that it has a solubility of less than about 1.5% by weight at the melting point or liquidus temperature of the matrix material. Since the antiwelding element is virtually insoluble in the liquid state of the major constituent, the structural integrity of the major constituent is not impaired and contact erosion will therefore remain low. The unfortunate tendency of the prior art copper-bismuth materials to form long protrusions and have entire grains pulled from the contact material surface during contact opening, will be greatly diminished in the contact materials of the present invention because of the greatly reduced restraining tendency of the chromium or major constituent structure. Thus the antiwelding action is based primarily on the vapor deposition of the antiwelding element on the contact surface with the minor constituent acting as a convenient reservoir for containing the anitwelding component. In this respect the element bismuth has fulfilled this criteria admirably well. As noted herein before, the most attractive candidate materials for supplying the electrical and thermal conductivity are the metals silver, copper, and aluminum.

In carrying out the present invention in one form, sintered matrices were prepared from chromium as the major constituent. The chromium powder, obtained commercially, was cold pressed until a theoretical density of approximately 60% was obtained. The material was then sintered in a vacuum furnace at an elevated temperature and infiltrated with a minor constituent consisting of liquid copper in which a small percentage of bismuth was dissolved. Upon cooling, the specimens were machined the desire contact dimensions and brazed into position inside a vacuum interrupter body which was then out-gassed and sealed off in a conventional fashion. Because of the volatility of the bismuth, the exact composition varied throughout the processing but it was found that if as little as 0.3% bismuth remains in the final electrode material, appreciable reduction in the welding force is noted.

Two samples of materials were made and tested in two vacuum interrupters having substantially identical construction. One interrupter contained electrodes having contact surfaces which were made according to the teachings of the present invention while the other interrupter contained electrodes in which the minor constituent consisted only of copper without the addition of bismuth. The test involved currents produced in a tank oscillating circuit at 60 Hz with a decrement of 7% per cycle. The results indicate that the impact force required to break the resulting welds is a steep function of the current applied. Up to 35 kiloamps, both interruptors performed essentially the same. But at higher currents the superiority of the interrupter made according to the present invention is clearly evident.

Additional experiments have shown that there is no degradation of the interrupting capability and chopping level due to the presence of small amounts of bismuth. Since the invention is concerned mainly with weld breaking problem of electrodes, it is generally sufficient that only those regions which touch each other need be made of this material. Other portions of the electrode can be made from any structurally sound material having sufficiently good electrical conductivity and the other desired properties which are suitable for use in a vacuum environment.

What is claimed is:

1. A contact material consisting essentially of a refractory material matrix which comprises at least 50% by weight of the contact material, said refractory material matrix having a melting point in excess of 1250° C and a boiling point of less than 3500° C, from about 0.3% to about 2.0% of an element displaying antiwelding characteristics in a vacuum environment and which has a solubility of less than 1.5% at the melting point temperature of the matrix material and the balance essentially being a metal having a high electrical and thermal conductivity.

2. The contact material of claim 1 in which the matrix material is chromium.

3. The contact material of claim 1 in which the metal of high thermal and electrical conductivity is selected from the group consisting of copper, silver and aluminum and alloys thereof.

4. The contact material of claim 1 in which the anti-welding element is selected from the group consisting of bismuth, lead, tellurium, thallium and mixtures thereof.

5. The contact material of claim 1 in which the refractory matrix is selected from the group consisting of chromium, iron, zirconium, cobalt, nickel, manganese and mixtures thereof.

6. The contact material of claim 5 in which the refractory matrix is selected from the group consisting of borides and carbides.

7. A contact material consisting essentially of a chromium matrix which is present in an amount of more than 50% by weight of the contact material, from about 0.3% to about 2% of bismuth and the balance essentially copper.

8. The contact material of claim 7 in which up to about 0.25% of an element selected from the group consisting of titanium and zirconium is included within the contact material.

* * * * *